United States Patent [19]

Combette et al.

[11] 4,113,163

[45] Sep. 12, 1978

[54] FASTENING TOOL USING CASELESS MUNITION

[76] Inventors: Marc Combette, 116, rue des Moulins, 26000 Valence; Roger Dorgnon, Avenue de St-Romain de Lerps, 07130 St Peray; Jean Luthringer, 16, Avenue Vion Whitcomb, 75016 Paris; Jean Ollivier, 80, Avenue de Beaumes, 26000 Valence, all of France

[21] Appl. No.: 805,663

[22] Filed: Jun. 13, 1977

Related U.S. Application Data

[63] Continuation-in-part of Ser. No. 723,831, Sep. 16, 1976, which is a continuation of Ser. No. 628,628, Nov. 4, 1976, abandoned.

[51] Int. Cl.[2] ..... B25C 1/14

[52] U.S. Cl. ..... 227/10

[58] Field of Search ..... 227/8, 9, 10, 11

[56] References Cited

U.S. PATENT DOCUMENTS

| | | | |
|---|---|---|---|
| 2,970,314 | 2/1961 | Temple et al. | 227/8 |
| 3,659,768 | 5/1972 | Brunelle | 227/10 |
| 3,899,113 | 8/1975 | Brack | 227/10 |
| 4,037,770 | 7/1977 | Dorgnon et al. | 227/9 |

FOREIGN PATENT DOCUMENTS

| | | | |
|---|---|---|---|
| 1,806,568 | 5/1970 | Fed. Rep. of Germany | 227/10 |

*Primary Examiner*—Granville Y. Custer, Jr.
*Attorney, Agent, or Firm*—William W. Jones; Paul J. Lerner

[57] ABSTRACT

The invention concerns a fastening tool employing a caseless munition. The tool includes a cavity for the munition, or explosive chamber, constituting a high-pressure chamber communicating with a low-pressure expansion chamber through at least one passage. The cavity for the munition, or explosive chamber, is formed radially in the very body of the breech, access thereto for loading being located on the periphery of said breech. It is possible to close said access after loading with a closing member, and the passage or passages putting the munition cavity in communication with the low-pressure chamber are formed in said breech.

10 Claims, 19 Drawing Figures

FASTENING TOOL USING CASELESS MUNITION

This is a continuation-in-part of application Ser. No. 723,831, filed Sept. 16, 1976, which in turn is a continuation of application Ser. No. 628,628, filed Nov. 4, 1976, now abandoned.

The present invention relates to a fastening tool using a caseless munition of the type comprising a cavity for the munition or explosive chamber, forming a high pressure chamber communicating with a low pressure expansion chamber through at least one passageway.

In known constructions of this type of apparatus, the anvil, against which the munition is struck, and the passageway are an integral part of the barrel so as to avoid the loss of a separate part when handling the apparatus. The closing surface of the explosive chamber is at least adjacent to one of the base surfaces of the caseless munition which has a cylindrical shape. The cavity itself may be formed in the rear part of the barrel or on the front face of the breech.

These constructions have various drawbacks: an anvil integral with the barrel does not permit a direct-firing gun to be loaded from the rear. Placing the caseless munition in its cavity, and its retention during the closure, are delicate operations.

An object of the invention is to avoid these drawbacks of known tools.

In the tool according to the invention, the cavity for the munition, or the explosive chamber, is formed radially in the very body of the breech, the access thereto for loading being located on the periphery of said breech, it being possible to close said access after loading with a closing member and the passageway or passageways putting the munition cavity in communication with the low pressure chamber being formed in said breech.

Preferably, the closing member is a cylindrical, tubular member coaxial with the breech.

The tool according to the invention may be of the direct firing type or indirect firing type. In both cases, the closing member may be integral with the barrel.

In one embodiment, the closing member is mounted to be slidable in a direction parallel to the axis of the barrel. By way of a modification, it is arranged to be capable of undergoing an angular movement about the axis of the breech. In the latter case, if it concerns a cylindrical tubular member, it has an opening giving access to the munition cavity. In the case of a indirect firing tool, that is to say a tool in which the sealing plug is driven in under the effect of the displacement of a piston or inertia block propelled by the gases of combustion of the munition, the cylindrical tubular member may be constituted by a hollowed-out portion of the rear of the inertia block.

In the tool according to the invention, the breech comprises the anvil necessary for igniting the munition, which avoids the provision of one which is connected to the barrel. Moreover, it is possible to adjust in a very simple manner the volume defined between the front face of the breech and the confronting face of the member performing the function of projectile, which volume is the initial volume of the low pressure chamber. In this way, the firing power can be easily regulated.

The invention will be understood, from the ensuing description with reference to the accompanying drawings in which.

Figure 2:
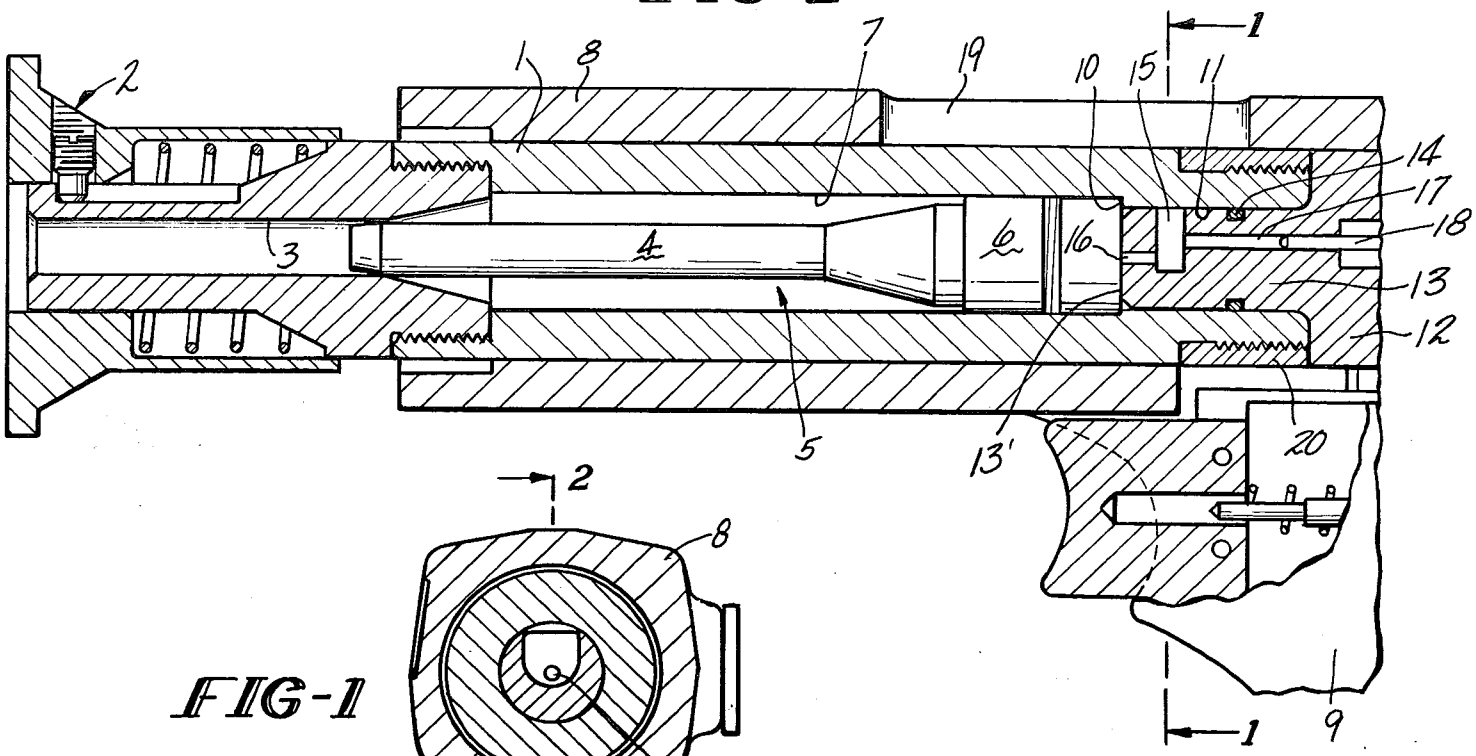
FIG. 2 is a sectional view taken on line 2—2 of FIG. 1, the tool being closed.
Figure 1:
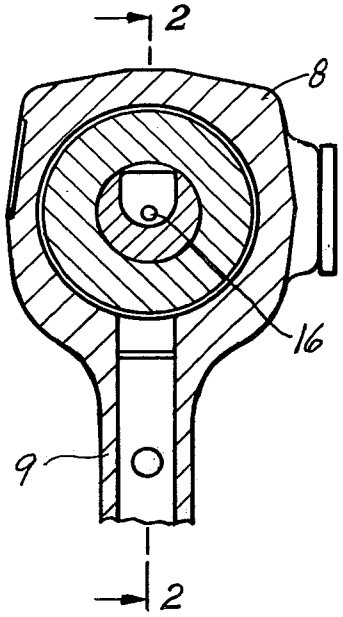
FIG. 1 is a partial cross-sectional view of one embodiment of a tool according to the invention taken on line 1—1 of FIG. 2.
Figure 3:
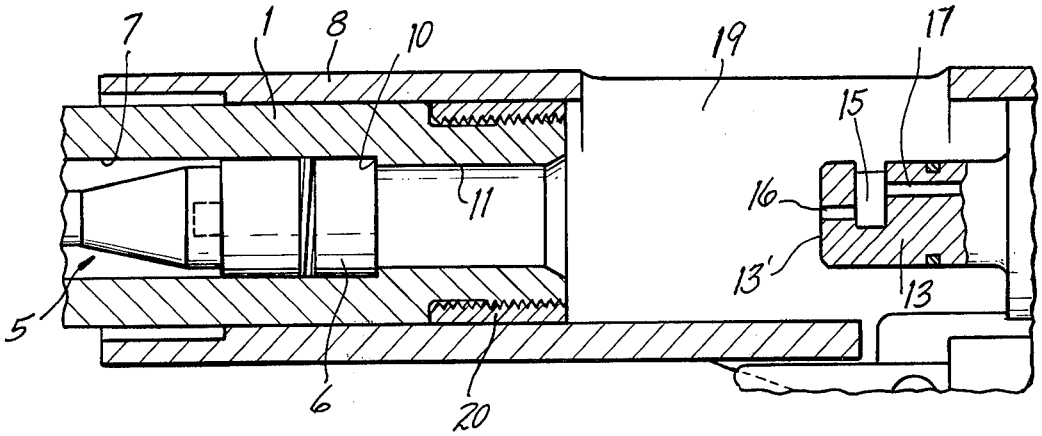
FIG. 3 is similar to FIG. 2, the tool being open for loading the munition.
Figure 4:
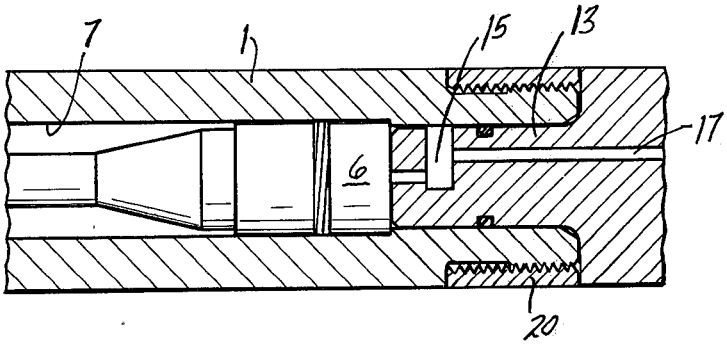
FIGS. 4 and 5 show a part of the tool shown in FIGS. 1 to 3 in respect of two distinct relative positions of the breech and barrel.
Figure 5:
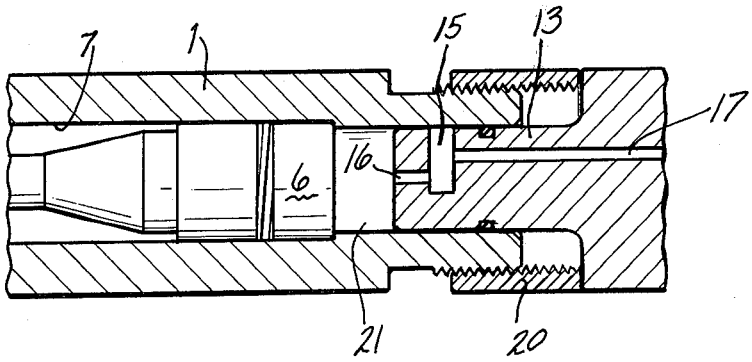

With reference first to FIGS. 1 to 5 which concern an indirect firing tool, the tool comprises a barrel 1 extended forwardly by a conventional shield system 2 which will not be described. The barrel 1 comprises a first axial bore 3, formed in the system 2 and receiving the fastener (not shown) and the front end 4 of a fastener driving member 5 whose rear part 6 of larger diameter slides in a second bore 7 of the barrel. The barrel 1 is slidably mounted with respect to a sleeve 8 integral with the grip 9 of the tool which combine to make up the tool housing.

The second bore 7 of the barrel 1 has a shoulder 10 performing the function of an abutment for the rear of the enlarged part 6 of the fastener driving member and defining a third bore 11 whose diameter is less than that of the bore 7. A breech 12, slidable with respect to the sleeve 8 and the grip 9, comprises a cylindrical front part 13 cooperating with the bore 11 of the barrel. In the illustrated embodiment, a sealing ring 14 is interposed between the part 13 and the barrel 1.

According to the invention, a cavity 15 for the propelling charge (not shown) is formed in the part 13 of the breech 12 and is open on the periphery of the latter. A passage 16 leading from the cavity 15 opens onto the front face 13' of the cylindrical part 13. A passage 17 for the passage of a rod 18 of a striker system (not shown) opens onto the rear of the cavity 15. The sleeve 8 has an upper opening 19.

For loading the tool the barrel 1 is urged forwardly and carries along therewith the fastener driving member 5 by the action of the abutment 10. In the position shown in FIG. 3, the cavity 15 is fully open and the propelling charge is introduced therein by way of the opening 19 in the sleeve 8. It is possible to employ for this purpose chargers supplying the charge, usually in the form of a tablet, from the edge above the opening of the cavity 15.

The tool just described permits an easy and precise regulation of the firing power. For this purpose, in the illustrated embodiment, the rear end of the barrel 1 is screwthreaded and receives a threaded ring 20. When the ring 20 is completely screwed on the barrel so as not so project rearwardly (FIGS. 2, 3 and 4) after closure of the tool (FIGS. 2, 3 and 4), the rear of the fastener driving member is at a given distance from the front face 13' of the cylindrical part 13 of the breech 12. In the illustrated embodiment, this distance is zero. The volume 21 between the rear of the fastener driving member 5 and the front face 13' of the part 13, which is the initial volume of the low pressure or expansion chamber, is minimum and the firing power is maximum. On the other hand, when the ring is unscrewed so as to project from the rear of the barrel 1 (FIG. 5), the initial volume 21 is increased and the firing power is decreased.

Figure 6:
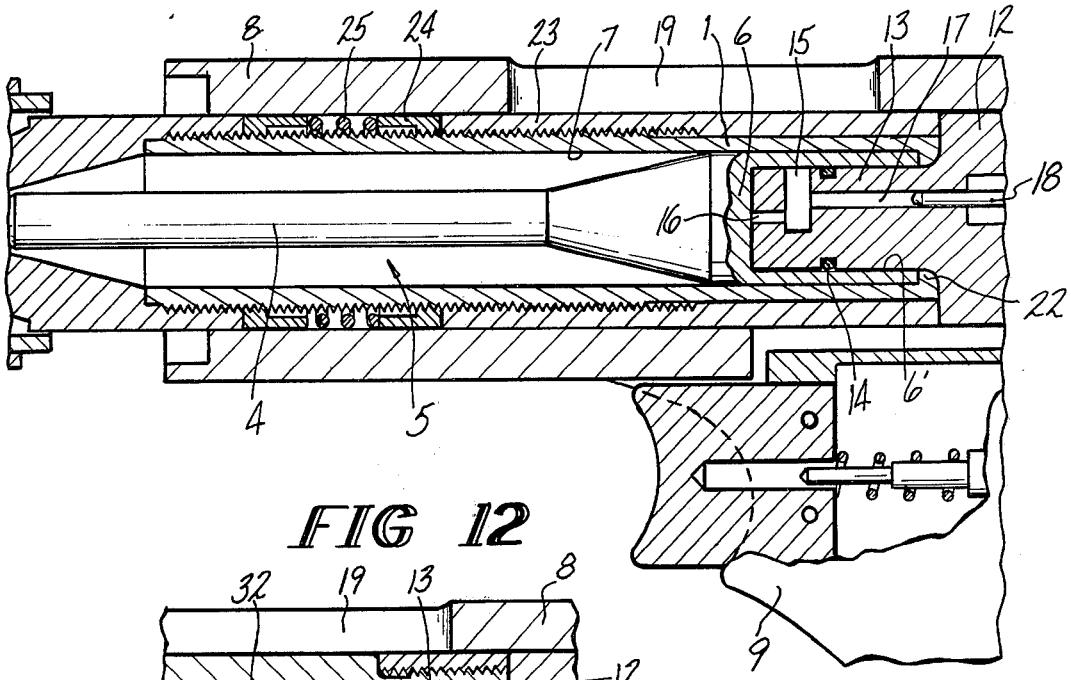
FIG. 6 is a partial cross-sectional view of a second embodiment of a tool according to the invention.
Figure 7:
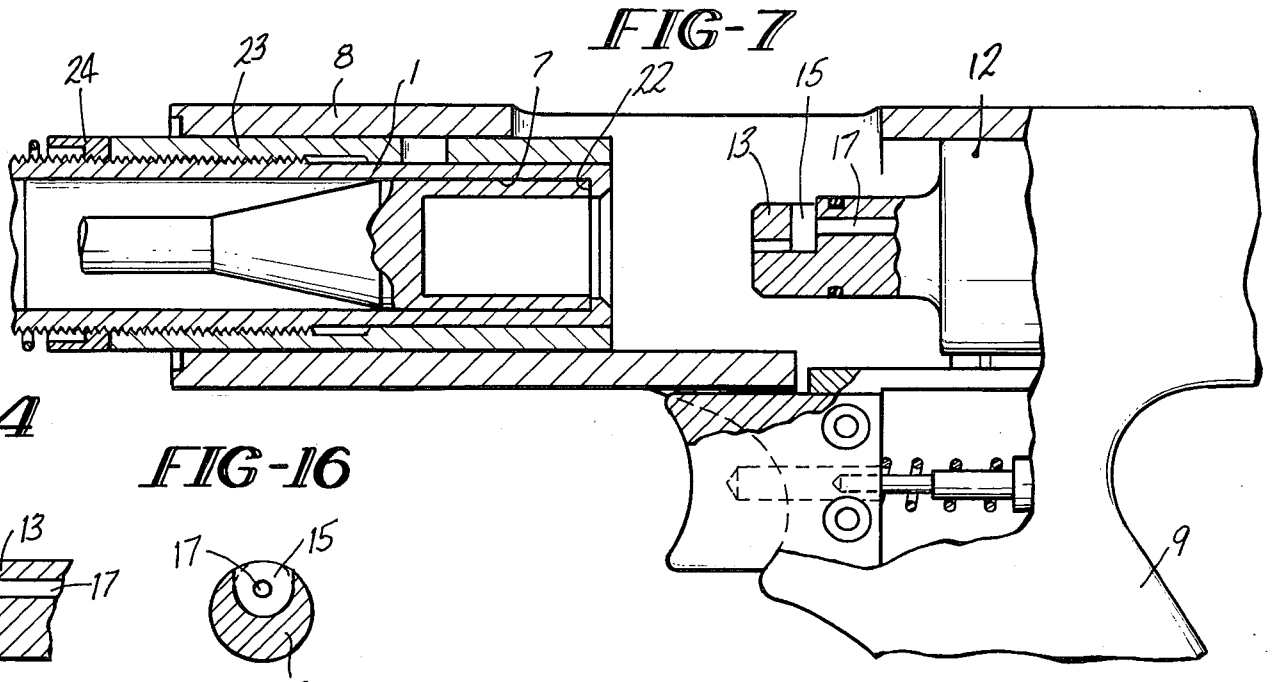
FIGS. 7 and 8 are partial cross-sectional views of the tool of FIG. 6 with the breech closed, showing different positions of the breech relative to the barrel.
Figure 8:
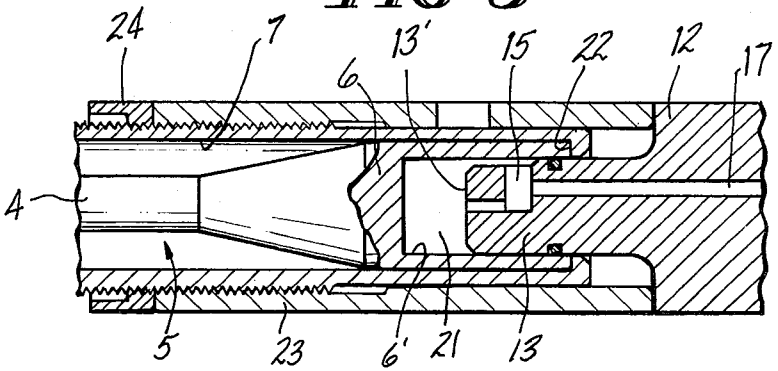

With reference to FIGS. 6 to 8 which represent a modification of an indirect firing tool according to the invention, the same references designate the same elements as in FIGS. 1 to 5. In this embodiment, the enlarged rear part 6 of the fastener driving member 5 has a blind axial bore 6' which serves as a cavity for the cylindrical part 13 of the breech 12 and consequently replaces the third bore 11 of the preceding embodiment. The bore 7 of the barrel 1 terminates at the rear in an inner annular abutment 22 which stops the fastener driving member 5 in its rearward movement. The low pressure chamber is therefore in this case initially defined by the end of the bore 6' and the front face 13' of the cylindrical part 13 of the breech 12. It is the peripheral wall of the bore 6' which closes the cavity of the munition. The barrel 1 is surrounded by a sleeve 23 which may be brought to a position projecting from the rear of the barrel 1 by screwing the sleeve along the barrel and locked by a notched ring 24 when the latter is freely biased by a spring 25. The firing power is regulated by varying the position of the sleeve 23 with respect to the barrel 1 which modifies the initial volume 21. This embodiment has the additional advantage of permitting the active recovery of the peripheral leakages of the high pressure chamber.

Figure 9:
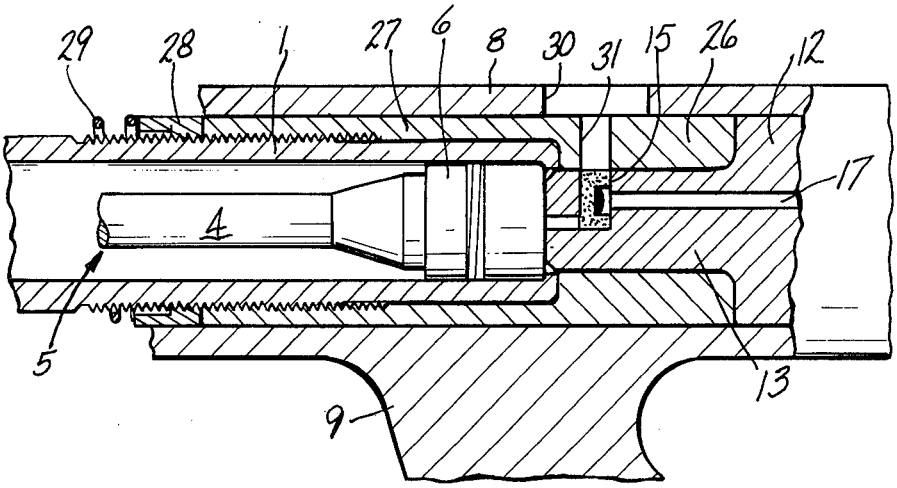
FIG. 9 is a partial cross-sectional view of a third embodiment of a tool according to the invention.
Figure 10:
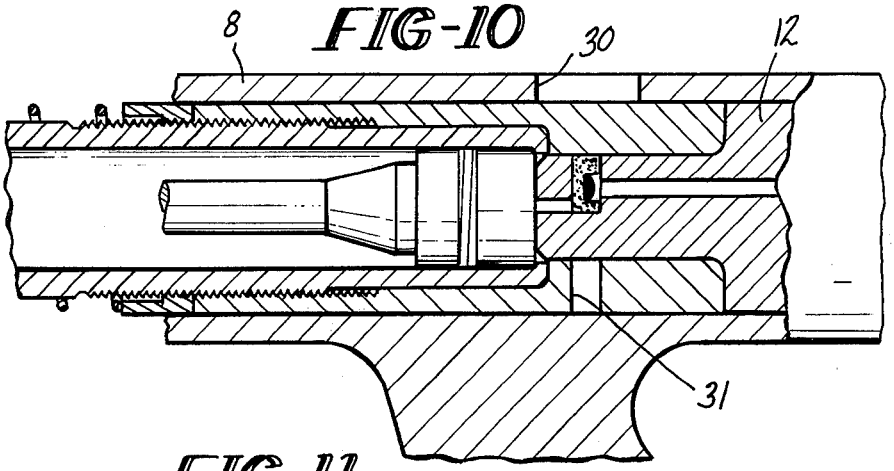
FIGS. 10 and 11 are partial cross-sectional view of the tool of FIG. 9 with the breech closed; showing different positions of the breech relative to the barrel.
Figure 11:
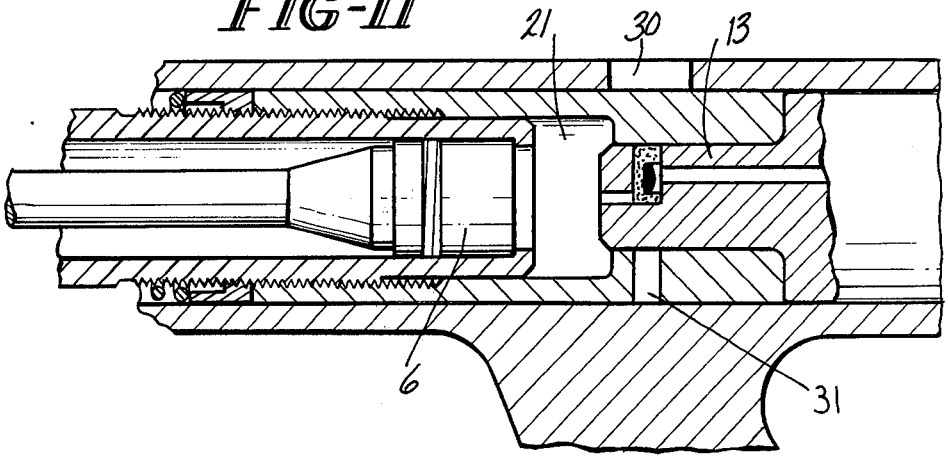

Reference will be made now to FIGS. 9 to 11 in which the same references designate the same elements as in the preceding figures. In this embodiment, the barrel 1 is extended rearwardly by a cylindrical tubular closing member 26 which is mounted on the barrel 1 by a portion 27 which is threadedly secured in an adjustable manner on the barrel 1 and locked by a threaded ring 28 biased by a spring 29. The sleeve 8, integral with the grip 9, has an upper opening 30 in front of the opening of the cavity 15 for the munition. In the same region, the member 26 has an opening 31 which, by rotation of this member 26 about its axis achieved by turning the barrel 1, can be brought into facing relation to the opening 30 (FIG. 9) for loading the munition. A rotation through 180° of the barrel (FIG. 10) puts the tool into firing position. The regulation of the initial volume of the low pressure chamber 21 (FIG. 11) is achieved by modifying the relative axial position of the portion 27 and the barrel 1 by means of their threaded interconnection.

Figure 12:
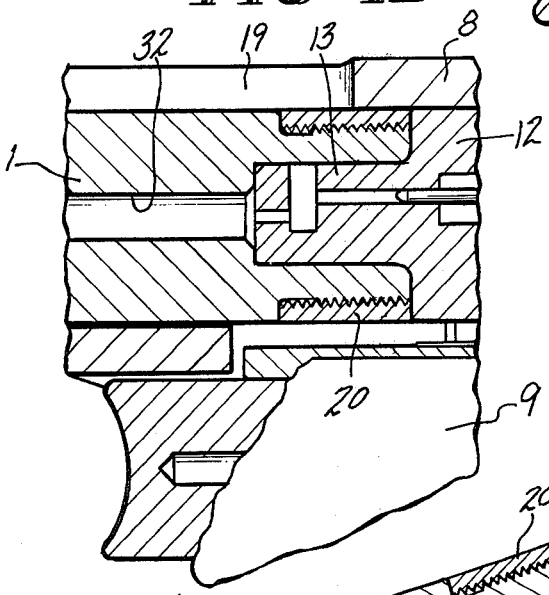
FIG. 12 is a partial cross-sectional view of a fourth embodiment of a tool according to the invention.
Figure 13:
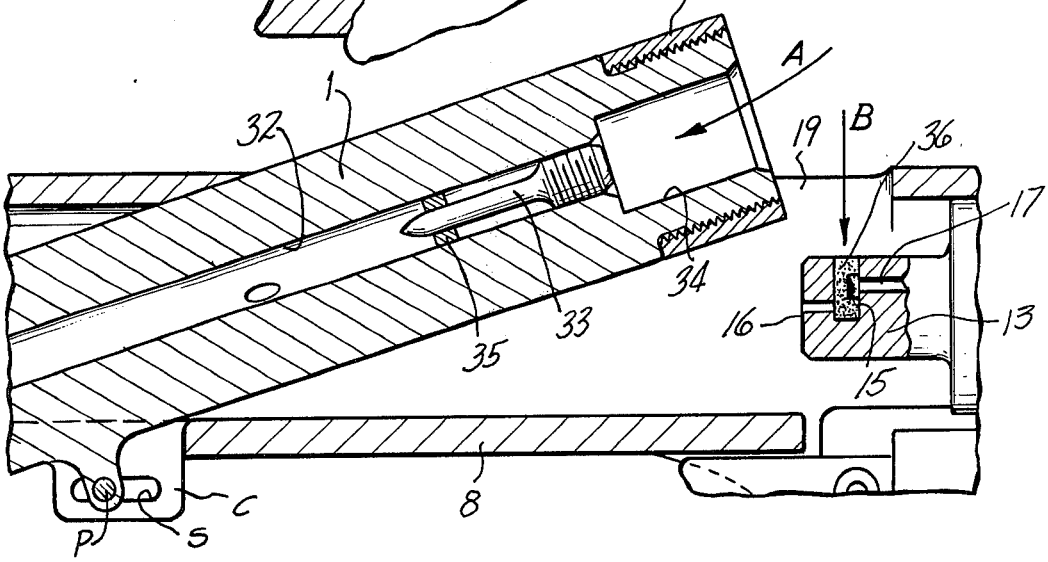
FIG. 13 is a partial cross-sectional view of the tool of FIG. 12 showing the breech open.

Reference will now be made to FIGS. 12 and 13 in which the same references designate the same elements as in the preceding figures. The tool is similar to that shown in FIGS. 1 to 5 but the barrel 1 has a small-diameter bore 32 receiving a fastener 33 (FIG. 12) which is driven by the tool. Extending this bore rearwardly is a bore 34 of larger diameter for receiving the cylindrical part 13 of the breech 12 and therefore corresponding to the bore 11 of the first embodiment described. The barrel 1 can moreover be mounted to slide and pivot with respect to the sleeve 8 by means of a clevis C having an elongated slot 5 on the sleeve 8, there being a pivot pin secured to the barrel 1 and slidable in the slot S to form the pivoting sliding connection. After the sliding and pivoting of the barrel 1 (FIG. 13), the fastener 33 is introduced in the bore 32 in the direction of arrow A and is maintained therein by a washer 35 carried by the fastener. The munition 36 is introduced in the direction of arrow B through the opening 19 as in the embodiment shown in FIG. 3. The power is regulated as in the tool shown in FIGS. 1 to 5, by means of the threaded ring 20.

Figure 16:
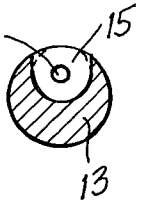
FIG. 16 is a cross-sectional view taken along line 16—16 of FIG. 14.
Figure 19:
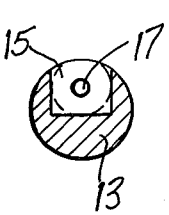
FIG. 19 is a cross-sectional view taken along line 19—19 of FIG. 17.
Figure 14:
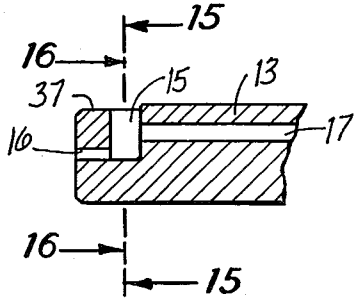
FIG. 14 is a partial, longitudinal sectional view of a part of a breech of a tool according to the invention.
Figure 17:
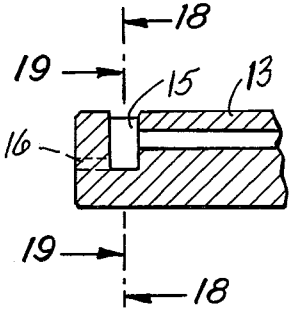
FIG. 17 is a partial cross-sectional view of an alternate embodiment of a part of a breech of a tool according to the invention.
Figure 15:
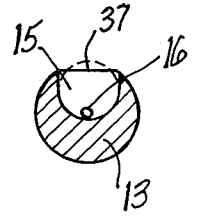
FIG. 15 is a cross-sectional view taken along line 15—15 of FIG. 14.
Figure 18:
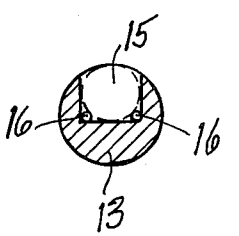
FIG. 18 is a cross-sectional view taken along line 18—18 of FIG. 17.

With reference now to FIGS. 14 to 16 which show an embodiment of the cylindrical part 13 of the breech, this cylindrical part comprises in the front end part a peripheral recess, here represented by a flat face 37 which defines, after closure of the cavity, instead of, or in addition to, the passage 16, a passage between this cavity 15 and the low pressure chamber. In the modification shown in FIGS. 17 to 19, the cavity 15 has a substantially square section and includes two passages 16 disposed at the lower corners of the cavity 15. In all cases, a thin minition of cylindrical shape is conveniently introduced by the edge of this munition.

In the embodiments described, the closing member for closing the cavity for the munition is cylindrical and tubular. However, it will be understood that it may have any other shape which permits, by some movement, the closure of the munition cavity.

We claim:

1. A powder-actuated tool of the type utilizing caseless munition, said tool including a housing, a breech in said housing, a barrel assembly mounted in said housing and having relative axial movement with respect to said breech between a forward and rearward position, said breech including an elongated portion extending toward said barrel, a caseless munition receiving chamber in said elongated portion, said receiving chamber including forward and rearward chamber walls and a munition loading opening in an axially extending surface of said elongated portion, closing means for overlying said opening to close the latter when the tool is in condition for firing, a low pressure chamber in said barrel assembly, and passageway means in said elongated portion providing communication between said chamber and said low pressure chamber.

2. The powder-actuated tool of claim 1 further including means for changing the volume of said low pressure chamber to regulate the firing power of the tool.

3. The powder-actuated tool of claim 1 wherein said barrel assembly includes a tubular barrel member, said barrel member having a portion thereof telescoping over said elongated projection to provide said closing means when said barrel assembly is in its rearward position.

4. The powder-actuated tool of claim 3 further including a fastener driving member mounted in said barrel member for movement between a forward fired position and a rearward firing position, means in said barrel member limiting the rearward relative movement of the fastener driving member with respect thereto, and means for adjusting the amount of rearward movement of said barrel assembly relative to said breech whereby the volume of said low pressure chamber can be changed.

5. The powder-actuated tool of claim 1 further including a fastener driving member mounted in said barrel assembly, said fastener driving member having a bore in its rearward face for receiving said elongated portion when said barrel assembly is moved into its rearward position to close said loading opening.

6. A powder-actuated tool of the type utilizing caseless munition, said tool including a housing, a breech in said housing, a barrel assembly mounted in said housing and having relative axial movement with respect to said breech between a forward and rearward position, said breech including an elongated portion extending toward said barrel, a caseless munition receiving chamber in said elongated portion having a munition loading opening extending perpendicular to the axis of elongation thereof, closing means for overlying said opening to close the latter when the tool is in condition for firing, a low pressure chamber in said barrel assembly, passageway means in said elongated portion providing communication between said chamber and said low pressure chamber, and a fastener driving member mounted in said barrel assembly, said fastener driving member having a bore in its rearward face for receiving said elongated portion when said barrel assembly is moved into its rearward position to close said loading opening, said barrel assembly including a barrel member, said fastener driving member being mounted in said barrel member, means in said barrel member for limiting the rearward movement of said fastener driving member relative to said barrel member, and means on said barrel member for abutment with said breech to limit the relative rearward movement of said barrel member with respect to said breech, said means on said barrel member being adjustable to vary the rearward most position of the barrel member with respect to said elongated portion to thereby change the volume of said low pressure chamber.

7. A powder-actuated tool of the type utilizing caseless munition, said tool including a housing, a breech in said housing, a barrel assembly mounted in said housing and having relative axial movement with respect to said breech between a forward and rearward position, said breech including an elongated portion extending toward said barrel, a caseless munition receiving chamber in said elongated portion having a munition loading opening extending perpendicular to the axis of elongation thereof, closing means for overlying said opening to close the latter when the tool is in condition for firing, a low pressure chamber in said barrel assembly, and passageway means in said elongated portion providing communication between said chamber and said low pressure chamber, said barrel assembly including a barrel member, a sleeve member attached to said barrel member and extending rearwardly therefrom, said sleeve member closing said loading opening when said barrel assembly is in its rearward position, an opening in said sleeve member, said barrel member and said sleeve member being rotatable about their axis whereby said opening in said sleeve member is aligned with said loading opening in one position of said barrel member, and out of alignment with said loading opening and the loading opening is closed in a second position.

8. The powder-actuated tool of claim 7 further including a fastener driving member mounted in said barrel member, means on said barrel member for limiting the rearward movement of said fastener driving member relative to said barrel member, said sleeve member abutting said breech in the rearward position of said barrel assembly to limit the relative rearward movement of said barrel assembly with respect to said elongated portion, said sleeve member being adjustable to vary the amount by which it extends from said barrel member so that the rearward position of the barrel member with respect to the elongated portion can be varied.

9. A powder-actuated tool of the type utilizing caseless munition, said tool including a housing, a breech in said housing, a barrel assembly mounted in said housing and having relative axial movement with respect to said breech between a forward and rearward position, said breech including an elongated portion extending toward said barrel, a caseless munition receiving chamber in said elongated portion having a munition loading opening extending perpendicular to the axis of elongation thereof, closing means for overlying said opening to close the latter when the tool is in condition for firing, a low pressure chamber in said barrel assembly, and passageway means in said elongated portion providing communication between said chamber and said low pressure chamber, said barrel assembly including a tubular barrel member, said barrel member having a portion thereof telescoping over said elongated portion when said barrel assembly is in its rearward position to close said loading opening, said barrel assembly having limited axial movement with respect to said breech to permit the barrel member to be moved forwardly out of telescoping relationship with said elongated portion, and means connecting said barrel assembly to said housing to permit the barrel assembly to be tilted out of alignment with said elongated portion.

10. The powder-actuated tool of claim 9 further including means on said barrel member for varying the distance by which the barrel member telescopes over said elongated portion when said barrel assembly is in its rearward position.

* * * * *